United States Patent [19]

Witte et al.

[11] Patent Number: 5,056,582

[45] Date of Patent: Oct. 15, 1991

[54] CORE BOX SHUTTLE SYSTEM

[75] Inventors: Raymond F. Witte, Romeoville; Clyde Eicher, Naperville; Donald F. Moonert, Somonauk; Pheroze J. Nagarwalla, St. Charles, all of Ill.

[73] Assignee: Disamatic, Inc., Oswego, Ill.

[21] Appl. No.: 627,342

[22] Filed: Dec. 14, 1990

[51] Int. Cl.[5] ..... B22C 7/06; B22C 9/10

[52] U.S. Cl. ..... 164/228; 164/186; 164/201

[58] Field of Search ..... 164/228, 186, 201, 200, 164/202

[56] References Cited

U.S. PATENT DOCUMENTS 4,718,474 1/1988 Bellis et al. ..... 164/228 X
4,832,108 5/1989 Nagarwalla et al. ..... 164/186 X
4,942,916 7/1990 Hale et al. ..... 164/201 X

FOREIGN PATENT DOCUMENTS 2-37938 2/1990 Japan ..... 164/201
1496906 7/1989 U.S.S.R. ..... 164/228

*Primary Examiner*—J. Reed Batten, Jr.
*Attorney, Agent, or Firm*—Marshall, O'Toole, Gerstein, Murray & Bicknell

[57] ABSTRACT

A core box shuttle system includes a shuttle car movable along a path, a movable shaft, a guiding surface carried by the shuttle car having a longitudinal extent transverse to the path and a slip-type connection between the movable shaft and the guiding surface whereby movement of the movable shaft is converted by the slip-type connection into movement of the shuttle car along the path.

21 Claims, 5 Drawing Sheets

CORE BOX SHUTTLE SYSTEM

TECHNICAL FIELD

The present invention relates generally to conveying apparatus, and more particularly to a shuttle system for a core making machine.

BACKGROUND ART

Core making machines are employed to produce sand cores that are in turn used to produce voids or recesses in cast parts. Such molding machines typically inject molding sand into a core box comprising first and second mating core box halves. In such machines, it is necessary to transport the core box into the machine such that it assumes a molding position wherein an extruding or injecting head can be moved into contact with the core box prior to injection of sand. Following production of the cores, and where the core box is of the horizontal parting line type, the drag or lower half of the core box must be moved away from the molding position so that the cores can be removed therefrom. Thus, there is a need to provide some type of transport mechanism for the core box which quickly and efficiently moves the core box to permit rapid production of cores.

When producing sand cores, it is important that the core box be positioned accurately relative to the extruding head. In the past, core making machines have utilized a shuttle car or platform that supported the core box and which was moved by some type of shuttle drive mechanism, such as a piston and cylinder device. However, since the shuttle car, the core box and cores formed therein have a substantial mass, it was difficult to rapidly move the car and core box with the required degree of accuracy using such a device.

In addition to the need to transport the drag toward and away from the molding position, the drag must be elevated into mating engagement with the upper core box portion or cope immediately prior to injection of molding sand and must be lowered away from the cope before the drag is moved away from the molding position. In the past, this was accomplished by elevating the shuttle car and the drag together immediately prior to movement of the extruding head against the mated core box halves. Such a transport mechanism experienced high stresses which led to metal fatigue in the shuttle car owing to the substantial pressures which had to be exerted by the extruding head against the core box and the shuttle car to prevent escape of sand as it was being injected into the core box. Further, the actuator for elevating the core box and shuttle car had to be of relatively high capacity owing to the combined weight of the core box and the shuttle car. Still further, a relatively complex connection was needed between the linear actuator that moved the shuttle car and the shuttle car itself owing to the requirement to move the car up and down.

SUMMARY OF THE INVENTION

In accordance with the present invention, a core box shuttle system rapidly and accurately positions a core box or a portion of a core box so that cores can be rapidly produced More particularly, a core box shuttle system includes a shuttle car movable along a path toward and away from a molding position and having first and second spaced main members, a cross member disposed atop the main members and means for supporting a core box portion atop the shuttle car together with means for moving the shuttle car along the path. Means are operable when the shuttle car is in the molding position and extending between the main members of the shuttle car for lifting the core box portion off the shuttle car.

Preferably, the cross member includes a lower surface between the main members at or above a first elevation and the lifting means has an upper surface disposed below the first elevation when the shuttle car is away from the molding position so that the lifting means does not interfere with the shuttle car as it is moving along the path.

Also preferably, the lifting means comprises a ram and a stool disposed between the ram and the core box portion when the shuttle car is in the molding position. Further, the moving means preferably comprises an actuator having a movable output shaft, a lever arm having a first end secured to the output shaft and a second end, a guiding surface carried by the shuttle car and means for providing a slip-type connection between the second end of the lever arm and the guiding surface.

In accordance with a further aspect of the present invention, a core box shuttle system includes a shuttle car movable along a path toward and away from a molding position and having means for supporting a core box portion thereon and an aperture therethrough, a movable shaft, means for moving the shaft and a guiding surface carried by the shuttle car having a longitudinal extent transverse to the path. Means are included for providing a slip-type connection between the movable shaft and the guiding surface whereby movement of the movable shaft is converted by the slip-type connection into movement of the shuttle car along the path. Means are operable when the shuttle car is in the molding position and extend through the aperture in the shuttle car for elevating the core box portion.

Preferably, the moving means comprises a rotary actuator that moves the movable shaft in a arcuate path. Also preferably, the providing means includes a roller rotatably mounted on an end of the movable shaft and disposed in contact with the guiding surface whereby the roller is movable along the guiding surface in response to movement of the movable shaft.

In addition, the guiding surface is preferably formed by a rail extending in a direction perpendicular to the path and the shuttle car is movably mounted on a guide rod.

In accordance with yet another aspect of the present invention, a core box shuttle system includes a shuttle car mounted for movement along a path toward and away from a molding position and having means for supporting a core box portion, an actuator disposed adjacent the path having a movable output shaft, a lever arm having a first end secured to the output shaft and a second end and a guiding surface carried by the shuttle car having a longitudinal extent traverse to the path. Means are provided in contact with the guiding surface and the second end of the lever arm for moving the second end of the lever arm along the guiding surface in response to movement of the movable output shaft such that the shuttle car is moved along the path Means are operable when the shuttle car is in the molding position for elevating the core box portion off the shuttle car.

Preferably, the coupling means comprises a roller mounted on the second end of the lever arm and disposed in contact with the guiding surface. Also in accordance with this aspect of the present invention, the actuator is preferably of the rotary type and moves the second end of the lever arm in an arcuate path.

In accordance with still another aspect of the present invention, a core box shuttle system includes a shuttle car mounted on spaced guide rods and movable along a linear path toward and away from molding position, the shuttle car including a pair of spaced, parallel main members disposed atop the spaced guide rods and a pair of spaced parallel cross members disposed atop and transversed to the main members wherein an aperture of a certain size is formed between the main members and the cross members and wherein a core box portion is supported on the shuttle car above the aperture A rotary actuator is disposed adjacent the linear path and a lever arm includes a first end secured to a rotatable output shaft of the rotary actuator. A rotatable roller is disposed on a second end of the lever arm and first and second spaced parallel guide rails are carried by the shuttle car beneath the first and second main members each having a longitudinal extent traverse to the linear path and together defining a channel therebetween. The roller is disposed within the channel in contact with one of the guide rails such that rotation of the output shaft causes movement of the roller in the channel to in turn cause movement of the shuttle car along the linear path. Also provided is a ram and a stool mounted on the ram having outer dimensions smaller than the size of the aperture wherein the ram is actuable when the shuttle car is in the molding position to cause the stool to extend through the aperture and lift the core box portion and wherein the ram may be deactuated to cause the stool to retract below the cross members so that the shuttle car can be moved away from the molding position.

Preferably in accordance with this aspect of the present invention, the longitudinal extent of the guide rails is perpendicular to the linear path. Also, the lever arm is movable in an arcuate path between first and second positions whereby the shuttle car is located at an end of the linear path when the lever arm is disposed in the first position and is located at the molding position when the lever arm is disposed in the second position.

The shuttle system of the present invention is simple in design yet is capable for providing the speed and accuracy necessary for use in a core molding machine.

DESCRIPTION OF THE PREFERRED EMBODIMENTS

Figure 1:
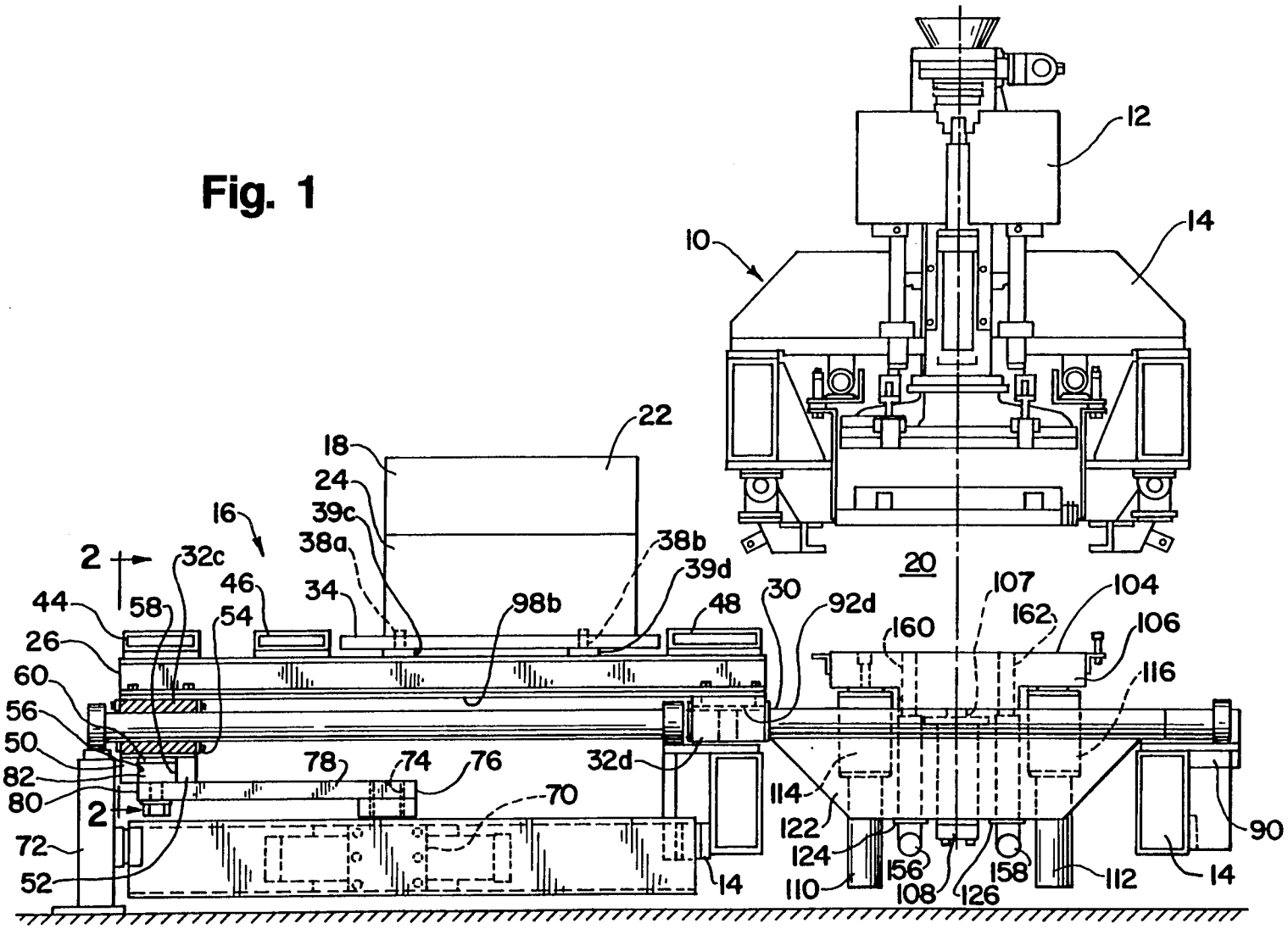
FIG. 1 is an elevational view of a core molding machine incorporating a shuttle system according to the present invention wherein various guards and frame members of the machine are omitted for the sake of clarity.
Figure 2:
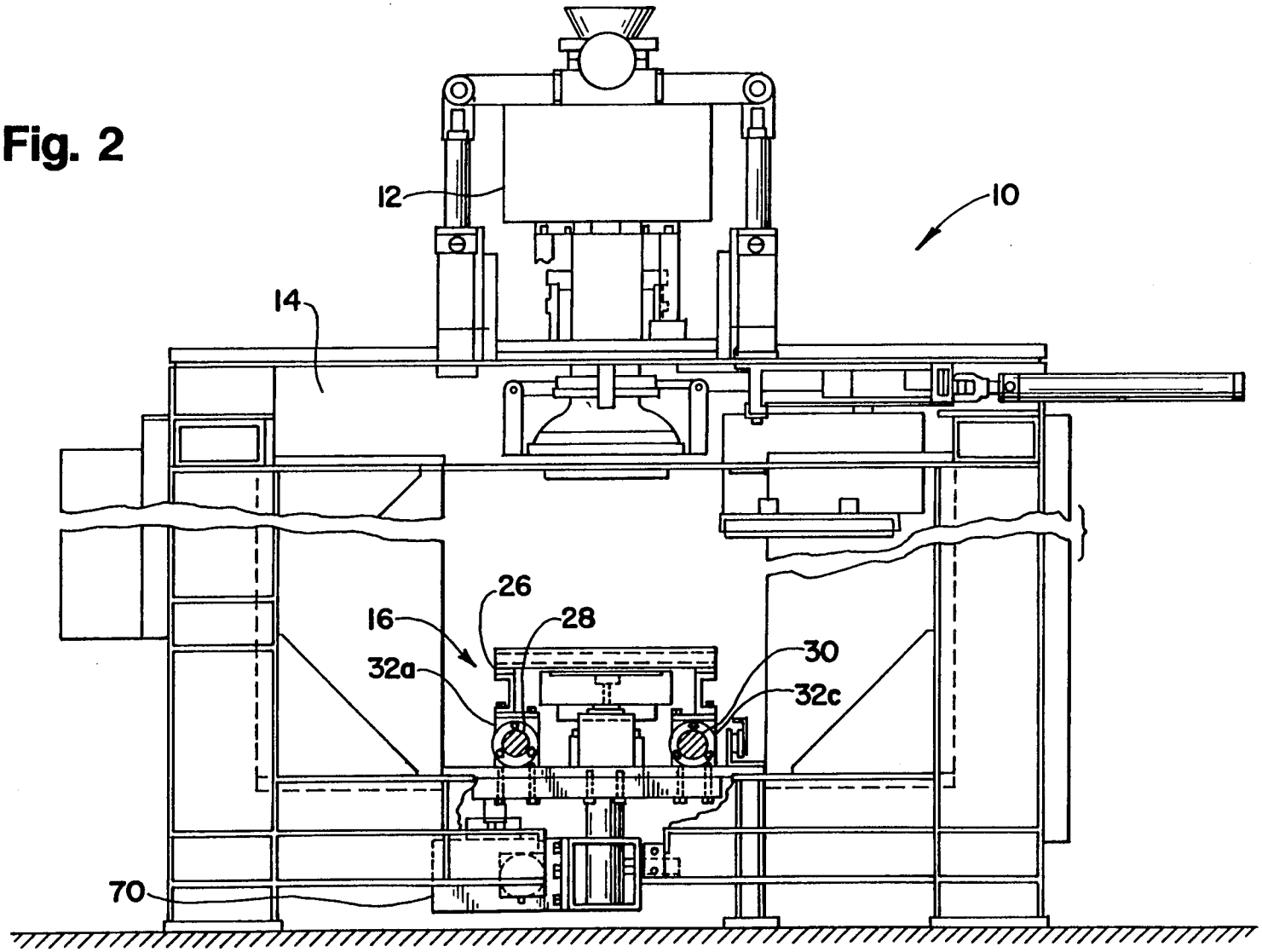
FIG. 2 is a sectional view of the core molding machine taken along the lines 2—2 of FIG. 1.
Figure 3:
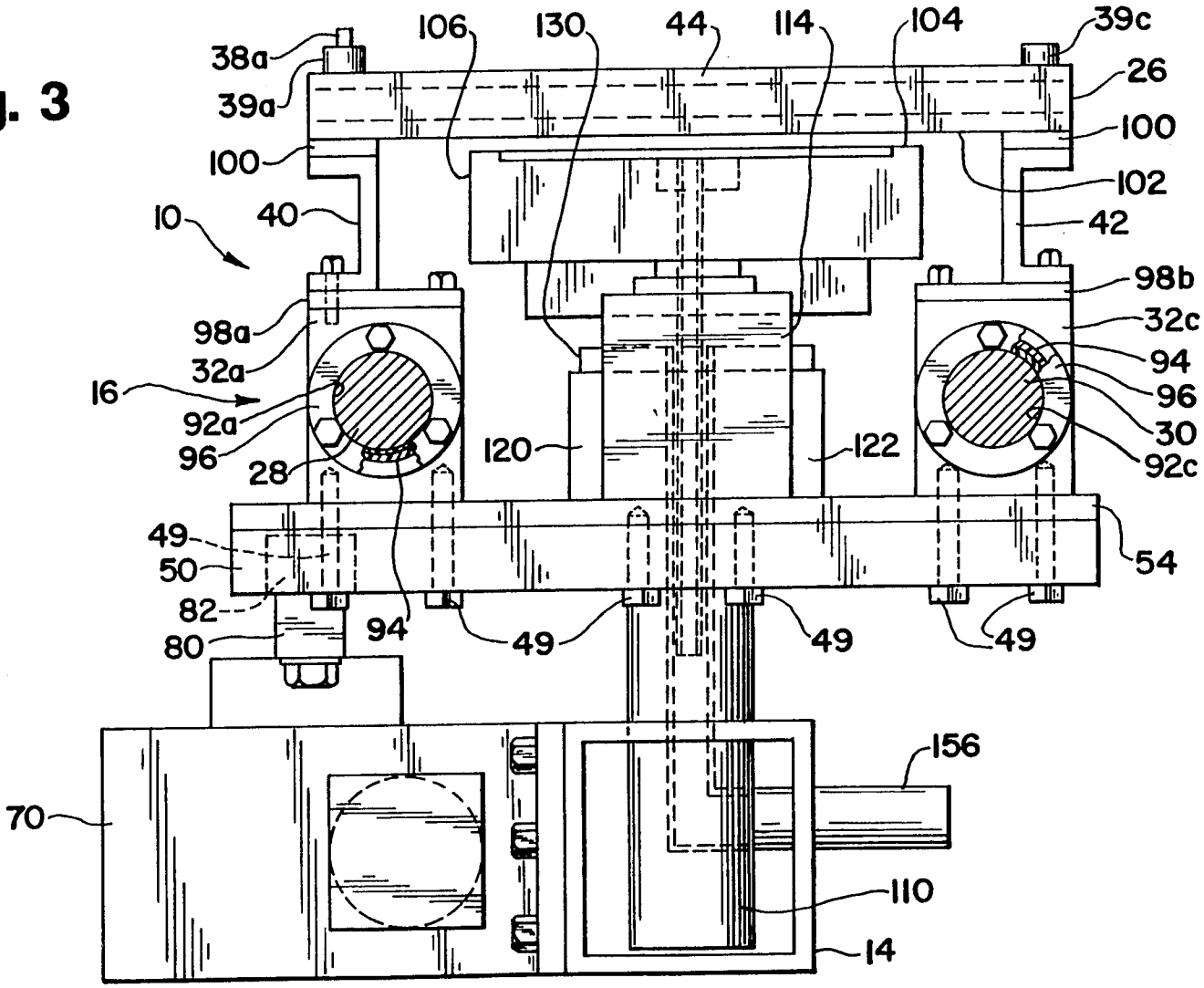
FIG. 3 is an enlarged fragmentary view of the shuttle system of FIG. 2.
Figure 4:
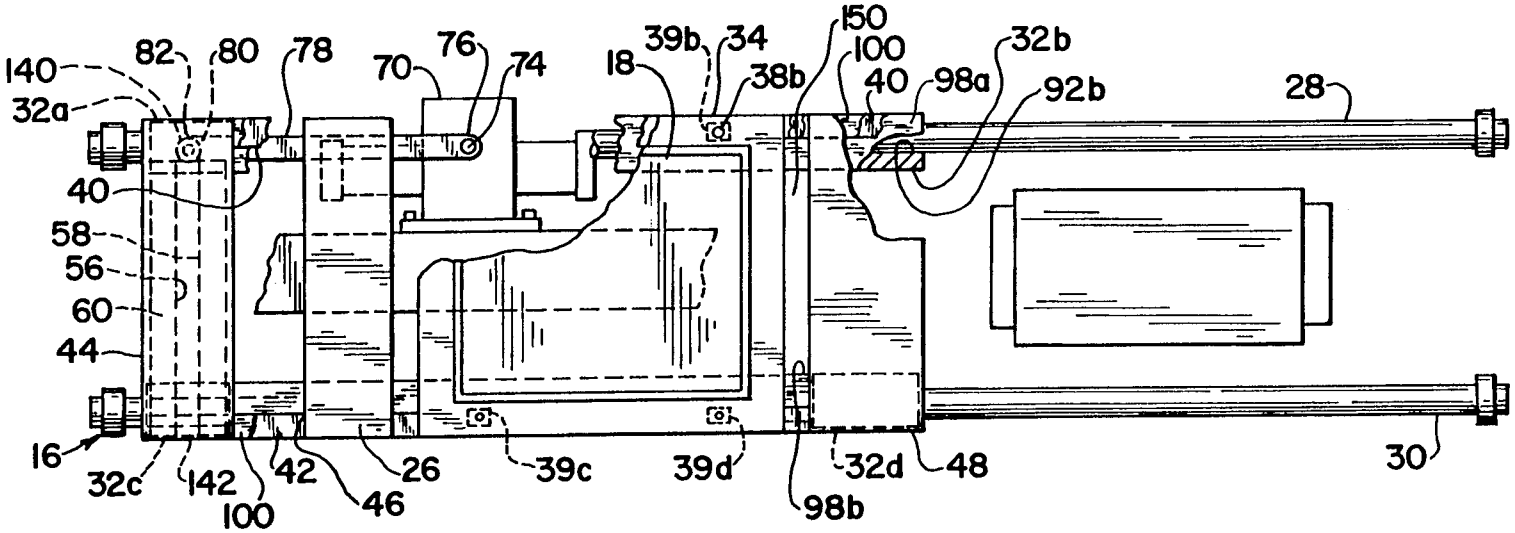
FIGS. 4–6 are simplified plan views of the shuttle system of the present invention during operation thereof.
Figure 5:
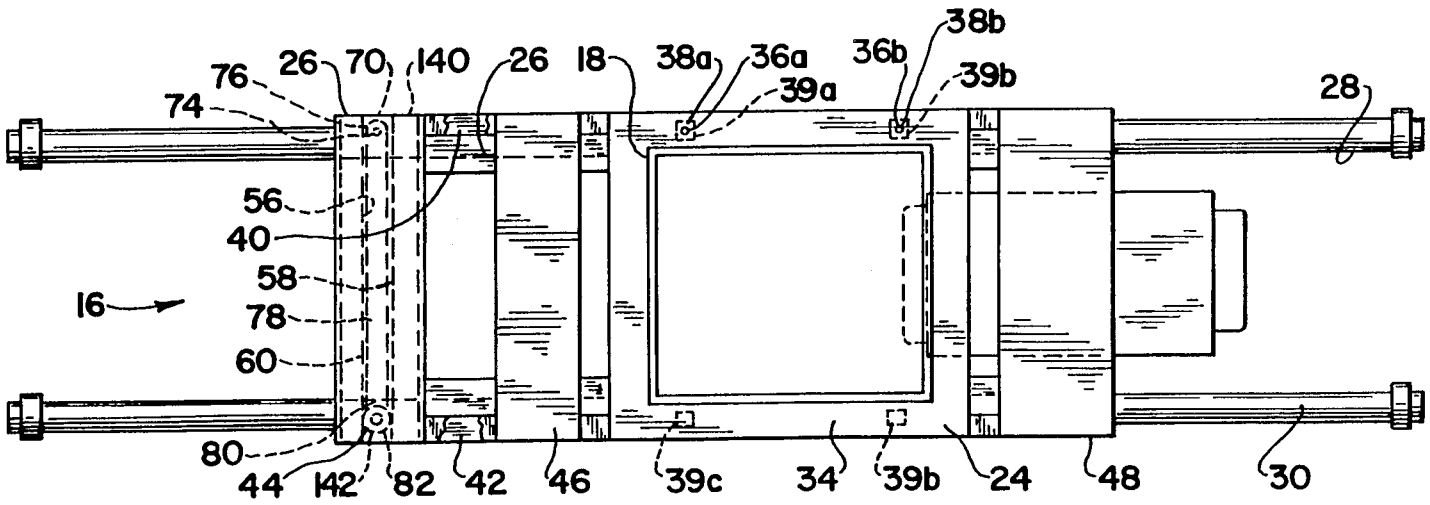
Figure 6:
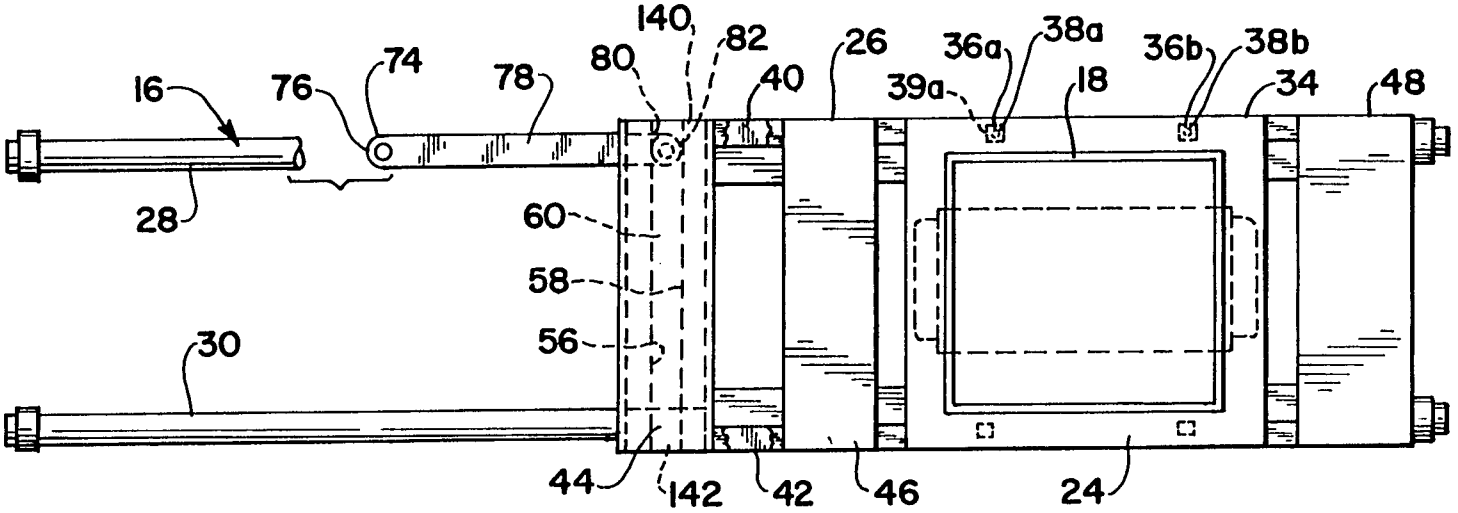

Referring now to FIGS. 1–3, a core molding machine 10 includes an extruding or injecting head 12 mounted on a stationary frame 14 and a shuttle system 16 according to the present invention. The shuttle system 16 transports a core box 18, FIG. 1, toward and away from a molding position 20 located directly beneath the extruding head 12. The core box 18 includes an upper half or cope 22 and a lower half or drag 24. While the molding machine 12 is illustrated as accommodating a core box 18 having a horizontal parting line, it should be understood that the molding machine 12 may instead accommodate a core box having a vertical parting line, if desired. Referring also to FIGS. 4–6, the drag 24 rests on a shuttle car 26 which is mounted for movement on first and second guide rods 28, 30 by means of bearing blocks 32*a*– 32*d* (the bearing block 32*b* is shown only in FIG. 4).

The drag 24 includes a base flange 34 having a pair of locating holes 36*a*, 36*b* therein. 25 The shuttle car 26 has a pair of locating pins 38*a*, 38*b* which extend upwardly from support pads 39*a*, 39*b* through the locating holes 36*a*, 36*b* when the drag 24 is properly positioned on the shuttle car 26. At such time, the drag rests on the support pads 39*a*, 39*b* as well as corresponding support pads 39*c*, 39*d*.

The shuttle car 26 includes first and second main support members 40, 42 on which the support pads 39*a*–39*d* are disposed and first through third parallel cross members 44, 46, 48 which are joined together and to the bearing blocks 32*a*–32*d* by welding or other means. Secured to the underside of the bearing blocks 32*a*, 32*c* by a number of bolts 49 (FIG. 3) or other fastening means is a guiding means in the form of a pair of guide rails 50, 52 secured to a base plate 54. The guide rails 50, 52 include guide surfaces 56, 58, which in turn define a channel 60 therebetween. The guide rail 50, 52 are transverse to the guide rods 28, 30 and more specifically are preferably, although not necessarily, perpendicular thereto.

A rotary actuator 70 (shown only in FIGS. 1–4) is disposed beneath the rails 28, 30 and is fixed at one end to a stanchion 72 which also supports one end of each of the rails 28, 30. The rotary actuator 70 is fixed at a second end to the frame 14 of the molding machine 10. The actuator 70 includes a rotatable output shaft 74 which is in turn secured to a first end 76 of a lever arm 78. Operation of the actuator 70 causes the output shaft 74 to rotate thereby causing the lever arm 78 to traverse an arcuate path. Secured to a second end 80 of the lever arm 78 is a rotatable roller 82 which is in turn disposed within the channel 60. The diameter of the roller 82 is 30 slightly less (preferably 0.003 inch) than the distance between the guide surfaces 56, 58.

Referring specifically to FIGS. 1 and 3, the guide rails 28, 30 are further supported by a stanchion 90 which is in turn fixed to the frame 14. The bearing blocks 32*a*–32*d* include cylindrical apertures 92*a*–92*d* therethrough, respectively, through which the guide rods 28, 30 extend. Wiper seals 94 provide sealing engagement between the guide rods 28, 30 and the bearing blocks 32*a*–32*d*. The rod seals are maintained in place by end rings 96 (only two of which are shown in FIG. 3) that are in turn bolted to the bearing blocks 32*a*–32*d*.

Bolted atop and straddling the bearing block 32*a*, 32*b* is a first base pad 98*a*, respectively. A second base pad 98*b* is bolted atop and straddles the bearing blocks 32*c*, 32*d*. Bolted atop the bearing pads 98*a*–98*d* are the main support members 40, 42 which, as seen in FIG. 3, are C-shaped in cross-section. Six spacer pads 100 are welded atop the upper flange of the main support members 40, 42 and the cross members 44, 46 and 48 are welded atop the spacer pads 100.

As seen in FIG. 3, the cross member 44 includes a lower surface 102 which is disposed at a first elevation. Corresponding lower surfaces of the cross members 46 and 48 are likewise disposed substantially at the same elevation. This elevation is located above an upper surface 104 of a lifting platen 106 when the platen is the fully retracted position as shown in FIG. 3. Referring also specifically to FIG. 1, the lifting platen 104 is coupled to a movable output shaft 107 of a hydraulic ram 108. The body of the hydraulic ram 108 is in turn secured by any suitable means to the frame 14 so that the ram may be actuated to elevate or retract the lifting platen 104. A pair of guide rods 110, 112 are secured to the lifting platen 104 and are slidable within first and second bearing sleeves 114, 116, respectively. The bearing sleeves 114, 116 are in turn secured to the frame 14 by side plates 120, 122, lower connecting plates 124, 126 as well as an associated plate 130 which are welded or otherwise fastened together.

FIGS. 4–6 illustrate movement of the shuttle car between a first end of its path of travel (illustrated in FIG. 4) and a second end of its path of travel (illustrated in FIG. 6). When the shuttle car is at the first end of the path, the roller 82 is disposed at a first end position 140 within the channel 60. Operation of the rotary actuator 70 causes the lever arm 78 to move in the arcuate path, as previously described. This, in turn, causes the roller 82 to bear against the guide surface 58 and thus move the shuttle car 26 to the right as seen in the Figures. Also at this time, the roller 82 advances from the first end position 140 toward a second end 92 position 142 within the channel 60.

FIGS. 5 illustrates the relative positioning of the lever arm 78 and the roller 82 within the channel 60 when the lever arm 78 is substantially parallel to the guide surfaces 56, 58 defining the channel 60. At this point, the roller 82 is disposed at its farthest distance from the end position 140. Preferably, although not necessarily, the roller 80 is disposed at this time at or near the second end position 142 within the channel 60.

Continued operation of the actuator 70 causes the shuttle car 26 to move farther toward the molding position 20, which position is reached when the output shaft 74 of the rotary actuator 70 reaches a predetermined angular position Preferably, although not necessarily, the lever arm 78 is disposed such that its longitudinal extent is perpendicular to the guide surfaces 56, 58 defining the channel 60 when the shuttle car 26 is located at the molding position 70.

Once the shuttle car 26 has been moved to the molding position 20, the lifting platen 106 is elevated by the ram 108 such that, the platen 106 extends through an aperture 150 defined by the cross members 46, 48 and the main members 40, 42. The upper surface 104 of the lifting platen 106 eventually contacts the lower surface of the drag 24 and continued elevation of the platen 106 elevates the drag 24 toward the cope 22. Eventually, the drag 24 comes into contact with the cope 22 so that injection of molding sand can take place.

Once the injection process has been completed, a conventional gassing process is undertaken to cure the cores in the core box 18. An exhaust system, as shown in FIGS. 1 and 3, including main exhaust tubes 156, 158 and inlet exhaust tubes 160, 162 telescoped within the main exhaust tubes 156, 158, respectively, removes gases from the core box 50. Seals (not shown), such as O-rings, may be provided between the tubes 156, 160 and between the tubes 158, 162 to prevent escape of exhaust gases. Thereafter, the drag 24 and lifting platen 104 are retracted by the ram 108 until the base flange 34 of the drag 24 rests on the support pads 39*a*–39*d* and the locating pins 38*a*, 38*b* extend through the locating holes 36*a*, 36*b*, respectively. The lifting platen 104 is then further retracted by the ram 108 until the upper surface 104 thereof is disposed beneath the lower surface 102 of the cross member 44 and corresponding lower surfaces of the cross members 46, 48. The shuttle car 26 may then be moved away from the molding position 20 by operating the actuator 70 such that the output shaft 74 thereof rotates in the opposite direction. This rotation in turn causes the roller 80 to bear against the guiding surface 56 and thus move the shuttle car to the left as viewed in FIGS. 4–6. At this point, the resulting cores in the drag 24 may be ejected and removed by suitable apparatus (not shown) and the drag 24 may be returned to the molding position 20 for the production of additional cores, as desired.

The slip-type connection afforded by the lever arm 78, the roller 82 and the guide rails 50, 52 permits the rotary motion of the output shaft 74 to be converted into linear motion along the path defined by the guide rods 28, 30 in a way that permits the shuttle car 26 to be moved rapidly toward and away from the molding position 20. The shuttle car 26 is smoothly and continuously accelerated until the position shown in FIG. 5 is reached, following which the shuttle car 26 is smoothly and continuously decelerated until the car 26 reaches the end of its travel. In addition, the shuttle car 26 is positioned accurately at the molding position 20 so that rapid and efficient processing of course can take place.

Figure 7:
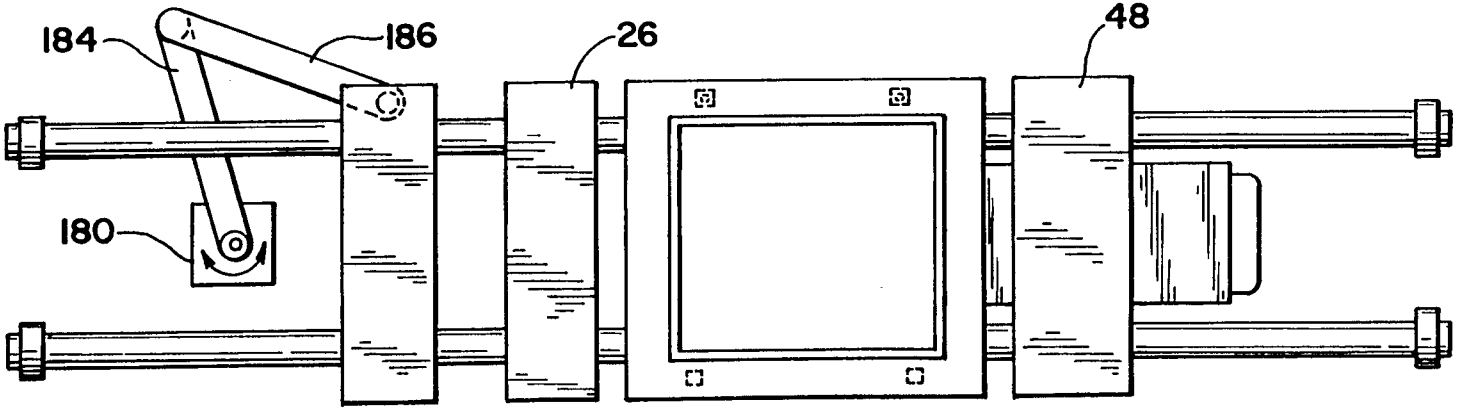
FIG. 7 is a diagrammatic plan view of an alternative embodiment of the present invention.

It should be noted that the orientation of the rotary actuator 70, the lever arm 78 and the guide rails 50, 54 may be changed so that the lever arm 78 moves in a plane perpendicular to the plane defined by the guide rods 28, 30 rather than in a plane parallel thereto. Alternatively, the rotary actuator can be replaced by a different type of actuator, such as a piston and cylinder unit having a piston rod coupled by slip-type connection to the shuttle car, if desired. Further, as seen in FIG. 7, the slip-type connection may be replaced by a rotary actuator 180 coupled to the shuttle car 26 by a linkage 182 formed by a pair of pivoting links 184, 186. Again, rotary motion supplied by the actuator 180 is translated into linear motion of the shuttle car 26 with excellent acceleration and deceleration at the ends of travel. Still further, the guide rails may be replaced by a single guiding surface of any suitable type which extends transversely to the path of motion of the shuttle car 26.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A core box shuttle system, comprising:

a shuttle car movable along a path toward and away from a molding position and having spaced main members, a cross member disposed atop the main members and means for supporting a core box portion atop the shuttle car;

means for moving the shuttle car along the path; and means operable when the shuttle car is in the molding position and extending between the main members of the shuttle car for lifting the core box portion off the shuttle car.

2. The core box shuttle system of claim 1, wherein the cross member includes a lower surface between the main members at or above a first elevation and wherein the lifting means has an upper surface below the first elevation when the shuttle car is away from the molding position so that the lifting means does not interfere with the shuttle car as it is moving along the path.

3. The core box shuttle system of claim 2, wherein the lifting means comprises a ram and a stool disposed between the ram and the core box portion when the shuttle car is in the molding position.

4. The core box shuttle system of claim 1, wherein the moving means comprises an actuator having a movable output shaft, a lever arm having a first end secured to the output shaft and a second end, a guiding surface carried by the shuttle car and means for providing a slip-type connection between the second end of the lever arm and the guiding surface.

5. A core box shuttle system, comprising: a shuttle car movable along a path toward and away from a molding position and having means for supporting a core box portion thereon and an aperture therethrough;

a movable shaft;

means for moving the shaft;

a guiding surface carried by the shuttle car having a longitudinal extent transverse to the path;

means for providing a slip-type connection between the movable shaft and the guiding surface whereby movement of the movable shaft is converted by the slip-type connection into movement of the shuttle car along the path; and means operable when the shuttle car is in the holding position and extending through the aperture in the shuttle car for elevating the core box portion.

6. The core box shuttle system of claim 5, wherein the moving means comprises a rotary actuator which moves the movable shaft in an arcuate path.

7. The core box shuttle system of claim 6, wherein the providing means includes a roller rotatably mounted on an end of the movable shaft and disposed in contact with the guiding surface whereby the roller is movable along the guiding surface in response to movement of the movable shaft.

8. The core box shuttle system of claim 5, wherein the guiding surface is formed by a rail extending in a direction perpendicular to the path.

9. The core box shuttle system of claim 5, further including a guide rod on which the shuttle car is movably mounted.

10. The core box shuttle system of claim 5, wherein the elevating means comprises a hydraulic ram and a stool on which the core box portion is disposed.

11. The core box shuttle system of claim 10, wherein the shuttle car comprises a pair of main members and a cross member mounted atop the main members wherein the cross member is disposed above the stool when the elevating means is not operated so that the cross member can pass over the stool as the shuttle car moves toward the molding position.

12. A core box shuttle system, comprising:

a shuttle car mounted for movement along a path toward and away from a molding position having means for supporting a core box portion;

an actuator disposed adjacent the path having a movable output shaft;

a lever arm having a first end secured to the output shaft and a second end;

a guiding surface carried by the shuttle car having a longitudinal extent transverse to the path;

means in contact with the guiding surface and the second end of the lever arm for moving the second end of the lever arm along the guiding surface in response to movement of the movable output shaft such that the shuttle car is moved along the path; and means operable when the shuttle car is in the molding position for elevating the core box portion off the shuttle car.

13. The core box shuttle system of claim 12, wherein the coupling means comprises a roller mounted on the second end of the lever arm and disposed in contact with the guiding surface.

14. The core box shuttle system of claim 12, wherein the actuator is of the rotary type and moves the second end of the lever arm in an arcuate path.

15. The core box shuttle system of claim 12, wherein the guiding surface is formed by a guide rail extending perpendicular to the path.

16. The core box shuttle system of claim 12, further including a guide rod on which the shuttle car is movably mounted.

17. The core box shuttle system of claim 12, wherein the elevating means comprises a hydraulic ram and stool on which the core box portion is disposed.

18. The core box shuttle system of claim 17, wherein the shuttle car comprises a pair of spaced main members movably mounted on a pair of guide rods and a pair of spaced cross members mounted atop the main members wherein an aperture is formed between the main members and between the cross members and wherein the cross members are disposed above the stool when the elevating means is not operated so that at least one of the cross members can pass over the stool as the shuttle car moves toward the molding position.

19. A core box shuttle system, comprising:

a shuttle car mounted on spaced guide rods and movable along L linear path toward and away from a molding position, the shuttle including a pair of spaced, parallel main members disposed atop the spaced guide rods and a pair of spaced parallel cross members disposed atop and transverse to the pair members wherein an aperture of a certain size is formed between the main members and the cross members and wherein core box portion is supported on the shuttle car above the aperture;

a rotary actuator disposed adjacent the linear path having a rotatable output shaft;

a lever arm having a first end secured to the output shaft and a second end;

a rotatable roller disposed on the second end of the lever arm;

first and second spaced parallel guide rails carried by the shuttle car beneath the first and second main members each having a longitudinal extent transverse to the linear path and together defining a channel therebetween;

wherein the roller is disposed within the channel in contact with one of the guide rails whereby rotation of the output shaft causes movement of the roller in the channel to in turn cause movement of the shuttle car along the linear path;

a ram; and a stool mounted on the ram having outer dimensions smaller than the size of the aperture;

wherein the ram is actuable when the shuttle car is in the molding position to cause the stool to extend through the aperture and lift the core box portion and wherein the ram may be operated to cause the stool to retract below the cross member so that the shuttle car can be moved away from the molding position.

20. The core box shuttle system of claim 19, wherein the longitudinal extent of the guide rails is perpendicular to the linear path.

21. The core box shuttle system of claim 19, wherein the lever arm is movable in an arcuate path between first and second positions whereby the shuttle car is located at an end of the linear path when the lever arm is disposed in the first position and is located at the molding position when the lever arm is disposed in the second position.

* * * * *